United States Patent [19]

Furniss

[11] Patent Number: 4,760,615

[45] Date of Patent: Aug. 2, 1988

[54] LIFT FOR USE WITH PATIENTS

[76] Inventor: Josephine Furniss, 2856 Lakewood Dr., Redding, Calif. 96001

[21] Appl. No.: 946,371

[22] Filed: Dec. 24, 1986

[51] Int. Cl.[4] ..... A61G 7/00; A61G 7/08

[52] U.S. Cl. ..... 5/63; 5/67; 5/68; 5/81 R; 5/81 B

[58] Field of Search ..... 5/11, 61, 63, 66, 68, 5/81 R, 81 C

[56] References Cited

U.S. PATENT DOCUMENTS

| | | | |
|---|---|---|---|
| 836,397 | 11/1906 | McGough . | |
| 1,078,077 | 11/1913 | Arnold . | |
| 1,866,397 | 7/1932 | Clewley . | |
| 2,523,076 | 9/1950 | Sweetland | 5/63 |
| 2,542,963 | 2/1951 | Knox et al. | 5/81 B |
| 2,587,094 | 2/1952 | Berg et al. | 5/63 X |
| 2,651,785 | 9/1953 | Berner | 5/63 |
| 2,870,460 | 1/1959 | Sanford | 5/11 X |
| 2,958,873 | 11/1970 | Ferneau . | |
| 2,984,843 | 5/1961 | Johnson . | |
| 3,053,568 | 9/1962 | Miller | 5/61 X |
| 3,308,485 | 3/1967 | Nesbit-Evans . | |
| 3,403,411 | 10/1968 | Steinemann et al. | 5/81 R |
| 3,611,453 | 10/1971 | Lokken . | |
| 3,686,696 | 8/1972 | Lanigan . | |
| 3,711,876 | 1/1973 | Kirkland et al. . | |
| 3,800,338 | 4/1974 | Smith | 5/68 X |

FOREIGN PATENT DOCUMENTS

| | | | |
|---|---|---|---|
| 87496 | 6/1955 | Denmark | 5/81 R |

*Primary Examiner*—Michael F. Trettel

*Attorney, Agent, or Firm*—Leonard D. Schappert

[57] ABSTRACT

A lift is provided for use in lifting and transporting patients which includes a tiltable platform to facilitate positioning of patients thereon and hinged head and/or foot platform sections to increase the comfort of a patient being transported thereon.

6 Claims, 2 Drawing Sheets

FIG. 5
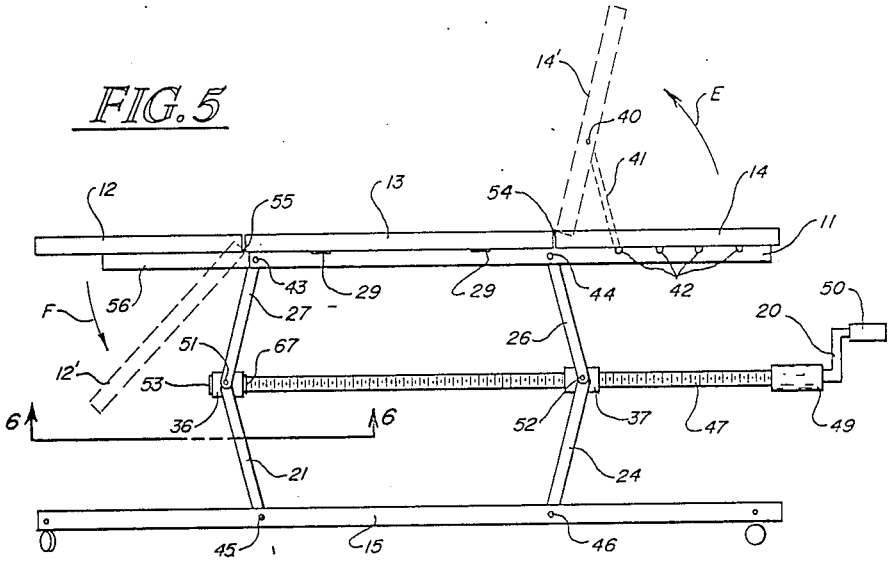
FIG. 6
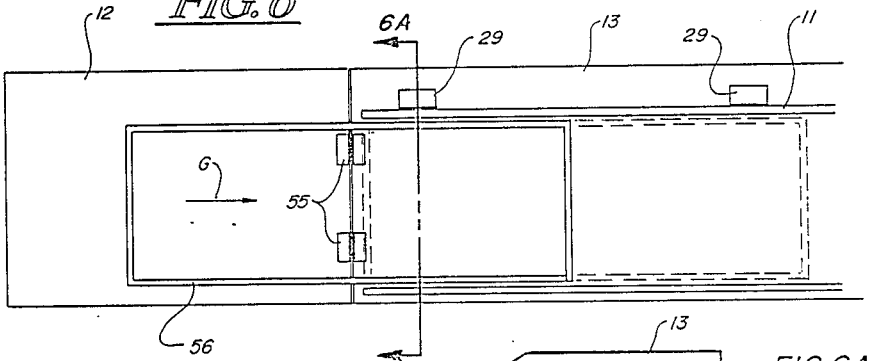
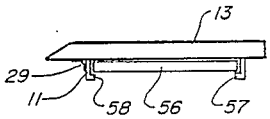
FIG. 6A
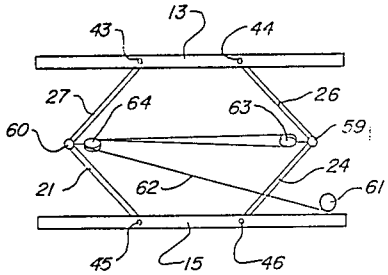
FIG. 7
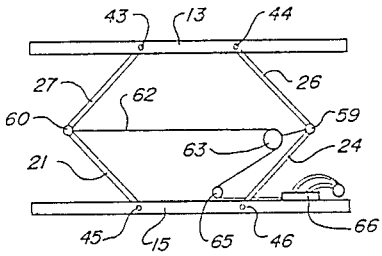
FIG. 8

LIFT FOR USE WITH PATIENTS

BACKGROUND OF THE INVENTION

1. Field of the Invention

This invention relates generally to devices utilized in lifting disabled individuals, and more specifically to a lift which includes provisions for lifting which enable health care professionals to roll an individual onto the platform of the lift, lifting him to a desired height, and also includes features which enable an individual being transported on the lift to sit up.

2. Description of the Prior Art

Lifts for use in lifting or transporting geriatric and other patients have in the past utilized scissor arrangements with latches to lock the lift into an upright position. More specifically, gurneys have included wheels for use in transporting individuals and have included the folding or scissor arrangement for use in folding the gurney into a size manageable for transport until an individual was placed thereon, at which time the lift mechanism was utilized and latched in position. Other inventors have directed their efforts toward creating hospital beds which include flexibility in the platform area enabling adjustment of the head section to allow an individual to sit up in bed. None of the prior art of which applicant is aware has taught a safe, dependable lift having the features taught in the present invention; specifically, full adjustability from near floor level up to a level consistent with shifting an individual from the lift platform to a bed, together with a tilt capability, whereby the platform of the lift tilts to enable a health care professional to roll a patient off the floor and onto the lift, and further specifically including a hinged head section and hinged foot section enabling an individual being carried on the platform to sit up during transport while having his legs and back supported.

SUMMARY OF THE INVENTION

The present invention is directed specifically to the creation of a lift for use in lifting geriatric or other patients who have fallen to the floor from the floor up to a position at the level of a hospital bed. This is accomplished by the present device, which includes a bottom frame on wheels so that the lift is transportable once in an upright position, and which further includes a platform attached to a top frame. The top frame and the bottom frame are attached through the use of an adjustable-height mechanism whereby the platform can be lowered to a position near the floor to enable health care providers to roll a patient onto the platform of the lift. The lift further includes pivot means by which the platform is attached to the upper frame so that, when the platform is tilted, one edge of the platform extends down substantially to the floor, effectively decreasing the difficulty which health care providers encounter when positioning a patient on the lift. The platform upon which the patient is positioned can be constructed of three sections: a center platform section with a head platform section hinged thereto and a foot platform section hinged thereto, the head platform section being hinged in such a way that it can be raised with respect to the center platform section, and the foot platform section being hinged so that it can be lowered with respect to the center platform section. The head platform section further includes a mechanism for positioning the head platform section to allow an individual being transported to sit at variously inclined positions.

As a result of the hinged head and foot platform sections, the lift is usable in a chair configuration so that the individual can sit much as he would in a chair.

One of the object of the present invention is to provide a safe, effective lift.

Another object of the present invention is to provide a lift which includes features which enable it to be lowered substantially to floor level or raised substantially to the level of a bed.

A further object of the present invention is to provide a lift which includes a tiltable platform so that, when it is lowered to its lowest position and the platform is tilted, a disabled individual can easily be rolled onto the platform.

Another object of the present invention is to provide a lift with a head platform section which is hinged to a center platform section so that it can be raised and lowered with respect to the center platform section, and which further includes means for adjusting the angle at which the head platform section is positioned with respect to the center platform section.

An additional object of the present invention is to provide a lift which includes a foot platform section which is hinged to the center platform section so that, when this assembly is combined with the head platform section, the platform of the lift can be conformed to the shape of a chair, enabling the individual being transported thereon to sit in relative comfort.

A further object of the present invention is to provide a lift including alternative lifting mechanisms.

The foregoing objects, as well as other objects and benefits of the present invention, are made more apparent by the descriptions and claims which follow.

BRIEF DESCRIPTION OF THE DRAWINGS

FIG. 5 is a side view of the lift showing more specifically the structure utilized in raising and lowering the lift, as well as the structure employed in tilting the head platform section upward with respect to the center platform section and tilting the foot platform section downward with respect to the center platform section.

FIG. 6 is a view of the mechanism utilized in holding the foot platform section in a horizontal position taken along lines 6—6 of FIG. 5.

FIG. 6A is a cross-sectional view taken along lines 6A—6A of FIG. 6.

FIG. 7 is a side view of the lift showing an alternative lift mechanism.

FIG. 8 is a side view of the lift showing a second alternative lift mechanism.

DESCRIPTION OF THE PREFERRED EMBODIMENT

Figure 1:
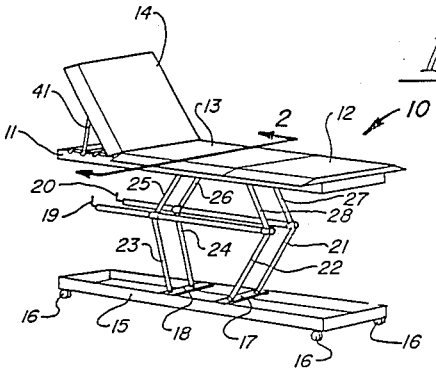
FIG. 1 is a perspective view of the lift showing the general construction thereof.
Figure 2:
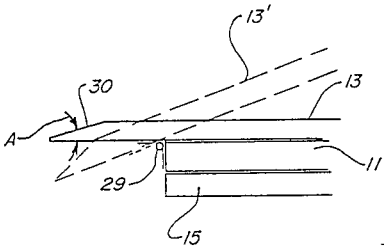
FIG. 2 is a cross-sectional view of the center platform section of the lift of FIG. 1 taken along lines 2—2 of FIG. 1 and showing the tilt capability of the platform.
Figure 3:
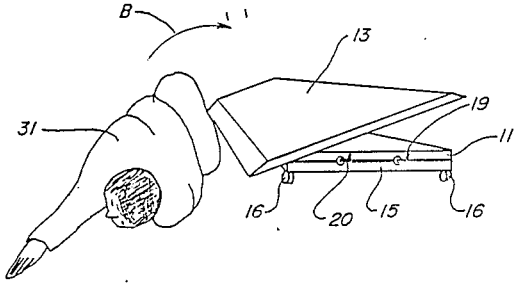
FIG. 3 is a perspective view of the lift in its fully lowered position showing how an individual is rolled onto the platform.

FIG. 1 of the drawings shows the construction of lift 10, including a base 15 with wheels 16 positioned on the bottom thereof to allow movement of base 15 on a substantially flat surface. Lift 10 further includes a frame 11 which is attached to a lift mechanism so that frame 11 can be raised and lowered with respect to base 15. The lift mechanism as shown here includes a scissor arrangement consisting of rods 21 and 22, 23 and 24, 25 and 26 and 27 and 28 attached to frame and base 15 in such a way that, as cranks 19 and 20 are turned, frame 11 is raised or lowered with respect to base 15. As shown here, rods 23 and 24 are substantially rigidly attached to rod 18, which is attached to base 15, and rods 21 and 22 are attached to rod 17, which is attached to base 15 to enable rods 21, 22, 23 and 24 to pivot with respect to base 15. The specific structure and attachment of the scissor arrangement to base 15 and frame 11 is more clearly set out in FIGS. 4 and 5 of the drawings. A platform upon which an individual is positioned for transport is attached to frame 11. The platform may consist of a single substantially rigid section as shown in FIG. 3 or of a series of sections as shown in FIG. 1, including a center platform section 13, which is attached by means of hinges or other pivot means to frame 11 as shown in FIG. 2, a head platform section 14 attached to center platform section 13 by hinges or other pivot means, and a foot platform section pivotally attached to the center platform section 13. This attachment is shown in greater detail in FIG. 5 of the drawings. Head platform section 14 further has adjustment means consisting of support rod 41 associated therewith so that its orientation with respect to center platform section 13 can be adjusted to maximize the comfort of the individual being transported on lift 10. The foot platform section 12 is attached to center platform section 13 by hinges or other pivot means which allow its orientation to be adjusted with respect to center platform section 13. The means associated with such adjustment are shown in greater detail in FIG. 5.

FIG. 2 of the drawings is a cross-sectional view of lift 10 showing the attachment of center platform section 13 to frame 11. This view shows the lift 10 in a lowered condition. Center platform section 13 is attached to frame 11 by pivot means 29 consisting of a hinge or any other acceptable pivot means which allow center platform section 13 to be tilted into the position shown as 13'. Further, center platform section 13, as well as foot platform section 12 and head platform section 14, includes an angled end 30 which is positioned at an angle sufficient to facilitate rolling an individual (31 in FIG. 3) onto the platform during use. While the specific angle A is not critical, it was found that an angle of 30 degrees is adequate. As center platform section 13 and frame 11 are lowered, frame 11 comes substantially into contact with base 15. This is necessary in order to ensure the easy rolling of an individual onto center platform section 13.

FIG. 3 of the drawings shows the lift 10 in position so that an individual 31 can be rolled as shown by arrow B into position thereon. Because of the pivotal attachment of center platform section 13 to frame 11, the end of center platform section 13 comes down against the surface of the floor. Cutout areas in frame 11 and base 15 allow cranks 19 and 20 to protrude while enabling frame 11 and base 15 to fold down into a substantially flush position with respect to each other.

Figure 4:
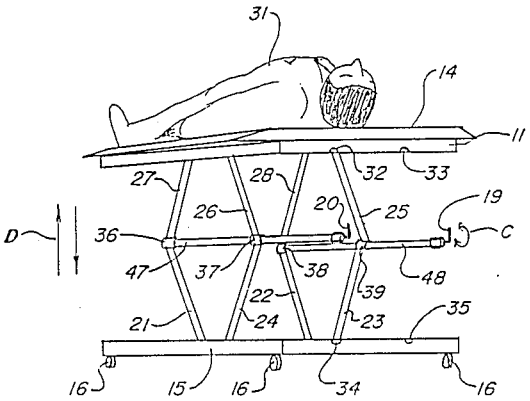
FIG. 4 is a perspective view showing the lift in an upright position and showing the structure and movement involved in raising and lowering the lift.

FIG. 4 is a perspective view more clearly showing the structure of lift 10. Frame 11 has cutout sections 32 and 33, and base 15 has cutout sections 34 and 35 positioned so that, as frame 11 is lowered down against base 15, crank 19 protrudes through cutout sections 33 and 35, and crank 20 protrudes through cutout sections 32 and 34, thereby allowing frame 11 to come down flush against base 15. Rods 47 and 48 are constructed of threaded rod with cranks 19 and 20 rigidly attached to the ends thereof so that, when cranks 19 and 20 are turned as shown by arrow C, rods 47 and 48 pull fitting 36 and threaded fitting 37 together and fitting 38 and threaded fitting 39 together or push them apart, thereby raising or lowering frame 11 along the line indicated by arrows D. Rods 23 and 25 are pivotally attached to threaded fitting 39 and to base 15 and frame 11, and rods 22 and 28 are pivotally attached to fitting 38 and to base 15 and frame 11. Rods 24 and 26 are pivotally attached to threaded fitting 37 and to base 15 and frame 11, and rods 21 and 27 are pivotally attached to fitting 36 and to base 15 and frame 11. Rod 47 extends through threaded fitting 37 and is captured with respect to fitting 36. As crank 19 and rod 48 are turned, fittings 38 and 39 are pulled together or pushed apart. Likewise, rod 48 extends through threaded fitting 37 and is captured with respect to fitting 36 so that, as crank 20 and rod 47 are turned, fitting 36 and threaded fitting 37 are pulled togetner or pushed apart. Frame 11 is raised or lowered with respect to base 15 as a result of cranks 19 and 20 being cranked.

FIG. 5 is a side view of the lift 10 more clearly illustrating the structure utilized in making the platform adjustable and capturing rod 47 with respect to fitting 36. The method of connecting the lift mechanism to base 15 and frame 11 is here shown in greater detail. Specifically, the arrangement of rod 47, together with threaded fitting 37 and fitting 36, is typical, and a substantially identical arrangement is employed with respect to rod 48. Rod 47 is threaded through threaded fitting 37 and extends through a hole in fitting 36 with a retainer 53 and a retainer 67 positioned on rod 47 on either side of fitting 36 and rigidly attached to rod 47 so that rod 47 is captured with respect to fitting 36. In an alternative arrangement, fitting 36 has a threaded hole into which rod 47 is threaded. In that particular arrangement, rod 47 and fittings 36 and 37 are threaded so that the lift is raised or lowered when rod 47 is turned. Rod 21 is pivotally attached to base 15 by pivot means such as a pin 45 and to fitting 36 by pivot means such as a pin 51. Rod 27 is pivotally attached to frame 11 by pivot means such as a pin 43 and to fitting 36 by pivot means such as a pin 51. Rods 24 and 26 are pivotally attached to threaded fitting 37 by pivot means such as pin 52, rod 26 is pivotally attached to frame 11 by pivot means such as pin 44, and rod 24 is attached to base 15 by pivot means such as pin 46. Center platform section 13 is attached to frame 11 by hinges 29 to allow it to tilt as shown in FIGS. 2 and 3. Foot platform section 12 is pivotally attached to center platform section 13 by pivot means such as hinges 55 which allow foot platform section 12 to tilt downward as shown by arrow F to the position shown as 12'. The mechanism utilized in holding foot platform section 12 in a horizontal position in line with center platform section 13 is shown in FIG. 6 of the drawings. Head platform section 14 pivots with respect to center platform section 13 and is attached thereto by pivot means such as hinge 54. Hinge 54 enables head platform section 14 to tilt upward as shown by arrow E from a horizontal position to the upright position shown as 14'. A support rod 41 is attached to head platform section 14 by pivot means such as pin 40, and can be adjusted and positioned in one of several detentes 42 provided in frame 11 to adjust the angle of nead platform section 14 with respect to frame 11 and center platform section 13. Crank 20 is substantially rigidly attached to rod 47 by a crank sleeve 49 or any other acceptable attachment means, and further includes a handle 50 to make it easier to crank.

FIG. 6 of the drawings is a bottom view of a portion of frame 11 and platform sections 12 and 13 taken along lines 6—6 of FIG. 5. More specifically, the means for holding foot platform section 12 in a horizontal position and for allowing it to be lowered is shown. Specifically, a frame 56 is slidably attached to frame 11 so that it slides as shown by arrow G into the position shown in dashed lines in order to allow foot platform section 12 to be lowered as shown in the dashed lines in FIG. 5. When frame 56 is positioned as shown in solid lines, foot platform section 12 is held in a substantially horizontal orientation. Center platform section 13 is attached to frame 11 by hinges 29.

FIG. 6A is taken along lines 6A—6A of FIG. 6 and shows the structure of frame 11, which captures frame 56 with respect thereto. Frame 11 includes lips 57 and 58, into which frame 56 slides, so that frame 56 is captured with respect to frame 11.

FIG. 7 of the drawings shows an alternative lift arrangement. Specifically, fitting 36 and threaded fitting 37 of FIG. 5 are replaced with simple pivot means 59 and 60 connecting rods 21 and 27 and rods 24 and 26 respectively. Pulleys 63 and 64 are attached to pivot means 59 and 60 respectively, and a cable 62 is attached rigidly to pulley 64 and routed around pulley 64, around pulley 63, back around and down to a hand crank 61 which, while such is not shown, has a safety stop built therein.

A second alternative lift arrangement is shown in FIG. 8 of the drawings which utilizes the pivot means 59 and 60 of FIG. 7 but a different pulley arrangement. Pulley 63 is attached to pivot means 59 and a cable 62, which is attached at one end to pivot means 60 and routed around pulley 63 and around pulley 65 to winch 66. Pulley 65 is attached to base 15 as shown. Winch 66 is electrically operated in this particular circumstance.

Both FIG. 7 and FIG. 8 show lift arrangements alternative to the arrangement shown in FIGS. 1, 4 and 5. The lift arrangements shown in FIGS. 7 and 8 are thought to be less safe, but are shown herein because of the inexpensiveness of the arrangements and their more than adequate safety level.

While the foregoing description of the invention has shown preferred embodiments using specific terms, such description is provided for illustrative purposes only. It is applicant's intention that changes and variations may be made without departure from the spirit or scope of the following claims, and this disclosure is not intended to limit applicant's protection in any way.

I claim:

1. A lift for lifting and transporting patients, comprising:

a bottom frame having a front end, a back end, a top and a bottom;

a top frame positioned above said bottom frame having a front end, a back end, a top and a bottom, said top frame being positioned with its front and back ends oriented substantially the same as are said front and back ends of said bottom frame;

a lift mechanism positioned substantially between said top of said bottom frame and said bottom of said top frame so that, when said lift mechanism is operated, said top frame rises or lowers with respect to said bottom frame;

a platform positioend on top of said top frame and pivotally attached thereto so that said platform tilts with respect to said top frame, thereby facilitating positioning of a patient thereon, said platform having:

a center platform section pivotally attached to said top frame;

a head platform section pivotally attached to said center platform section;

first positioning means for positioning said head platform section at different orientations with respect to said center platform section and said top frame;

a foot platform section pivotally attached to said center platform section so that said foot platform section lowers with respect to said center platform section and said top frame to increase the comfort of an individual being transported, and second positioning means for holding said foot platform section substantially stationary with respect to said center platform section consisting substantially of a support slidably attached to said lift so that in a first position said support holds said foot platform section substantially stationary with respect to said center platform section and in a second position said support releases said foot platform section so that said foot platform section lowers with respect to said center platform section, and rollers attached to said bottom frame whereby said lift is easily moved.

2. The invention of claim 1, wherein said lift mechanism includes:

at least two bottom rods, each of said bottom rods having a top end and a bottom end, said bottom end of each of said bottom rods being pivotally attached to said bottom frame;

at least two top rods, each of said rods having a top end and a bottom end, said top end of each of said top rods being pivotally attached to said top frame;

at least two fittings, each of said fittings being pivotally attached to said top end of one of said bottom rods and to said bottom end of one of said top rods, and adjusting means for adjusting and controlling the position of said fittings with respect of each other.

3. The invention of claim 2, wherein:

one of said fittings has a threaded hole therein, and said adjusting means consists substantially of a threaded rod threaded through said threaded hole in said one of said fittings and secured to another of said fittings so that said platform rises or lowers when said threaded rod is turned.

4. The invention of claim 2, wherein:

each of said fittings has a threaded hole therein, and said adjusting means consists of threaded rod threaded through said threaded holes in said fittings, the threads of said threaded rod and said threaded holes in said fittings being cut so that said fittings draw closer together or are pushed farther apart when said threaded rod is turned.

5. A lift for lifting and transporting patients, comprising:

a bottom frame having a front end, a back end, a top and a bottom;

a top frame positioned above said bottom frame having a front end, a back end, a top and a bottom, said top frame being positioned with its front and back ends oriented substantially the same as are said front and back ends of said bottom frame;

a platform positioned on top of said top frame and pivotally attached thereto so that said platform tilts with respect to said top frame, thereby facilitating positioning of a patient thereon, and a lift mechanism positioned substantially between said top of said bottom frame and said bottom of said top frame so that, when said lift mechanism is operated, said top frame rises or lowers with respect to said bottom frame, and having:

at least two bottom rods, each of said bottom rods having a top end and a bottom end, said bottom end of each of said bottom rods being pivotally attached to said bottom frame;

at least two top rods, each of said rods having a top end and a bottom end, said top end of each of said top rods being pivotally attached to said top frame;

at least two fittings, each of said fittings being pivotally attached to said top end of one of said bottom rods and to said bottom end of one of said top rods, and adjusting means for adjusting and controlling the position of said fittings with respect to each other consisting substantially of a pulley attached to one of said fittings and a cable attached to another of said fittings, said cable extending about said pulley so that as said cable is tightened, said platform rises, and as said cable is released, said platform lowers, and rollers attached to said bottom frame whereby said lift is easily moved.

6. A lift for lifting and transporting patients, comprising:

a bottom frame having a front end, a back, a top and a bottom;

a top frame positioned above said bottom frame having front end, a back end, a top and a bottom, said top frame being positioned with its front and back ends oriented substantially the same as are said front and back ends of said bottom frame;

a platform positioned on top of said top frame and pivotally attached thereto so that said platform tilts with respect to said top frame, thereby facilitating positioning of a patient thereon;

a lift mechanism positioned substantially between said top of said bottom frame and said bottom of said top frame so that, when said lift mechanism is operated, said top frame rises or lowers with respect to said bottom frame, and having:

at least two bottom rods, each of said bottom rods having a top end and a bottom end, said bottom end of each of said bottom rods being pivotally atached to said bottom frame;

at least two top rods, each of said rods having a top end an a bottom end, said top end of each of said top rods being pivotally attached to said top frame;

at least two fittings, each of and fittings being pivotally attached to said top end of oen of said bottom rods and to said bottom end of one of said top rods, and adjusting means for adjusting and controlling the position of said fittings with respect to each other consisting substantially of pulleys attached to at least two of said fittings and a cable which extends about said pulleys so that as said cable is tightened, said platform rises, and as said cable is released, said platform lowers, and rollers attached to said bottom frame whereby said lift is easily moved.

* * * * *